US006007044A

United States Patent [19]

Harrer

[11] Patent Number: 6,007,044

[45] Date of Patent: Dec. 28, 1999

[54] ADJUSTABLE-LENGTH COLUMN FOR CHAIRS OR THE LIKE

[75] Inventor: Harald Harrer, Bayreuth, Germany

[73] Assignee: Suspa Compart Aktiengesellschaft, Altdorf, Germany

[21] Appl. No.: 08/988,638

[22] Filed: Dec. 11, 1997

[30] Foreign Application Priority Data

Dec. 12, 1996 [DE] Germany ..... 196 51 653

[51] Int. Cl.[6] ..... A47C 1/02

[52] U.S. Cl. ..... 248/631; 248/161; 403/DIG. 7

[58] Field of Search ..... 248/161, 162.1, 248/631; 297/344.18, 344.19; 403/329, DIG. 7

[56] References Cited

U.S. PATENT DOCUMENTS

| | | | |
|---|---|---|---|
| 3,711,054 | 1/1973 | Bauer | 248/562 |
| 4,969,619 | 11/1990 | Bauer et al. | 248/161 |
| 4,979,718 | 12/1990 | Bauer et al. | 248/631 |
| 5,120,011 | 6/1992 | Mintgen et al. | 248/162.1 |
| 5,269,398 | 12/1993 | Wolf et al. | 248/161 X |

FOREIGN PATENT DOCUMENTS

| | | |
|---|---|---|
| 21 64 196 | 12/1971 | Germany . |
| 39 32 146 | 4/1991 | Germany . |

*Primary Examiner*—Ramon O. Ramirez
*Assistant Examiner*—Stephen S. Wentsler
*Attorney, Agent, or Firm*—Browdy and Niemark

[57] ABSTRACT

An adjustable-length column for chairs or the like comprises an upright tube with a pneumatic or hydropneumatic length-adjusting element disposed therein. The latter's piston rod, in the vicinity of its free end, is flexibly snap-engaged with a bottom plate of the upright tube.

9 Claims, 2 Drawing Sheets

FIG. 1
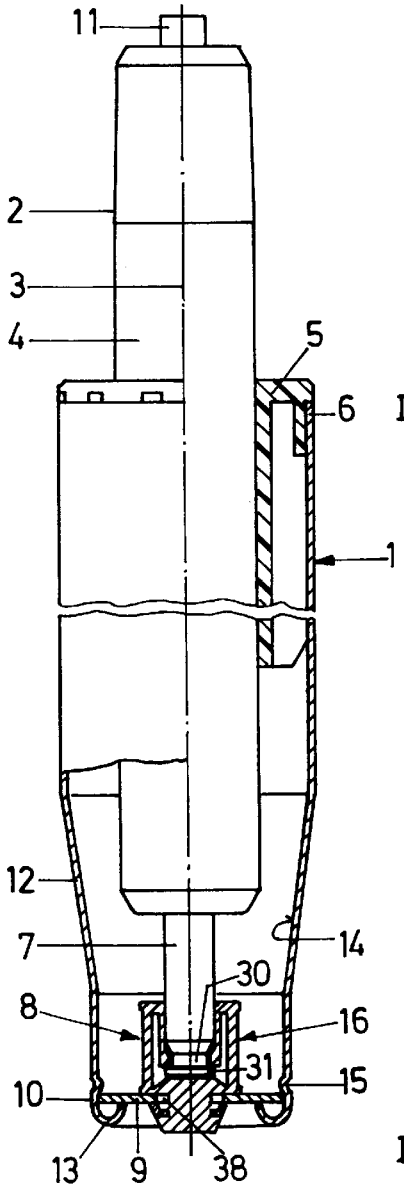
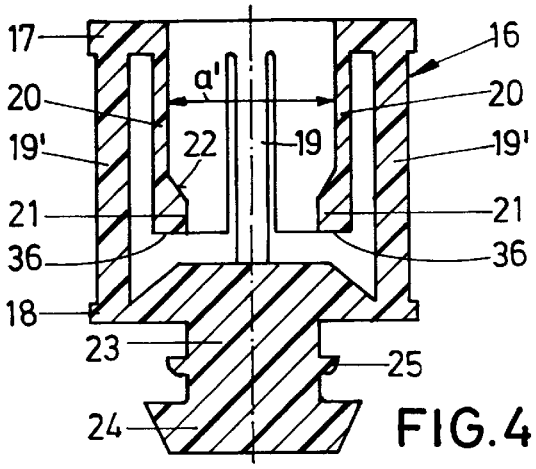
FIG. 4
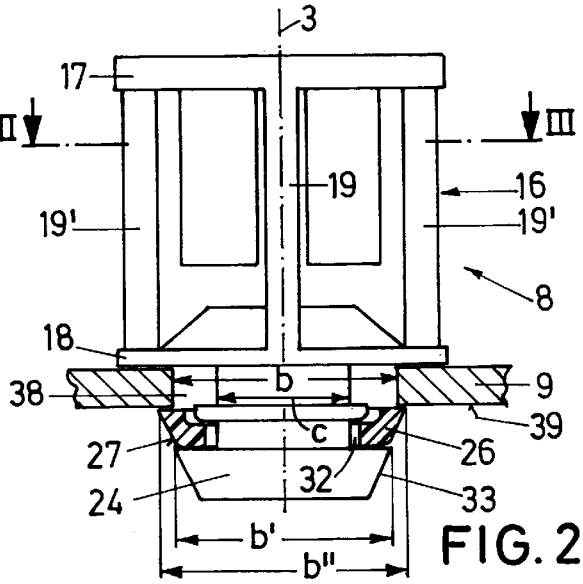
FIG. 2
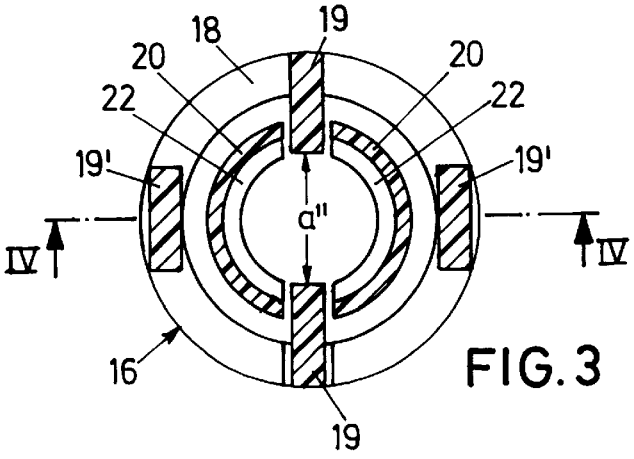
FIG. 3

ADJUSTABLE-LENGTH COLUMN FOR CHAIRS OR THE LIKE

BACKGROUND OF THE INVENTION

Field of the Invention

The invention relates to an adjustable length column for chairs or the like, comprising an upright tube and a pneumatic or hydropneumatic length-adjusting element which is disposed therein concentrically of a common central longitudinal axis and the housing of which is radially supported in the upright tube and guided for displacement in the direction of the axis and the piston rod of which, in the vicinity of its free end, is fixed in the direction of the axis on a bottom plate of the upright tube, the bottom plate having an opening.

BACKGROUND ART

It is known from U.S. Pat. No. 4,969,619 to support the piston rod on the bottom plate by way of an axial rolling bearing and to mount it releasably on the underside of the bottom plate by means of a flexible securing clamp. The mounting is complicated, the component parts of the axial rolling bearing first having to be slipped on a pin of the piston rod. Then the piston rod must be inserted from bottom to top into the upright tube which is held with its bottom plate upwards in order that the components of the rolling bearing do not come off the piston rod. After insertion into a corresponding opening of the bottom plate, a securing disk is placed on and then the securing ring of a corresponding securing clamp is installed.

For simplification, U.S. Pat. No. 5,269,398 teaches to retain the rolling bearing on the pin of the piston rod by means of a flexible ring, this constituting a pre-assembly and temporary safety device.

The design according to U.S. Pat. No. 5,120,011 fulfills the same purpose, the rolling bearing being held in a cage which is flexibly locked into place on the pin of the piston rod. Subsequent mounting in the upright tube again takes place in such a way that the pin is inserted through the opening in the bottom place, a shim is placed on, after which a securing ring or clamp is mounted.

SUMMARY OF THE INVENTION

It is the object of the invention to embody an adjustable-length column of the generic type in such a way that especially simple mounting of the gas spring in the upright tube is possible.

The solution according to the invention helps ensure that the end of the piston rod is pushed only partially through the opening in the bottom plate of the upright tube, elastically snap-engaging with the bottom plate. When a fastening pin, which passes through the opening of the bottom plate, is connected with the piston rod, a securing ring being disposed on the fastening pin, backing up the bottom plate and being compressible radially to the axis to have a diameter smaller than the diameter of the opening, this reflects an especially simple constructional solution, easy detachment of the gas spring from the upright tube being possible.

Further, it is of advantage that the securing ring is pushed through the opening of the bottom plate, the securing ring not being able to change its position in the direction of the axis of the piston rod.

The securing ring can be mounted on a retaining body which is again mounted on the end of the piston rod.

Furthermore, it can be of advantage if the retaining body supports itself on the bottom plate by means of a supporting plate, it being possible that also the piston rod supports itself by its front on this supporting plate. These measures ensure a safe support on the one hand and also rotatability of the gas spring relative to the upright tube on the other hand.

Furthermore, the retaining body can simultaneously serve as a flexible stop for the housing of the length adjusting element when the latter is retracted as far as possible into the upright tube.

Even though, fundamentally, the retaining body can be united tightly with the piston rod, for instance by injection-molding, it is of special advantage when the retaining body is flexibly snap-engaged also with the piston rod by a single operation.

Further features, advantages and details of the invention will become apparent from the ensuing description of exemplary embodiments, taken in conjunction with the drawing.

BRIEF DESCRIPTION OF THE DRAWING

FIG. 1 is a longitudinal section of a column according to the invention in an illustration partially broken open, FIG. 2 is a lateral view of a retaining body with the securing ring and the bottom plate illustrated in a sectional view, FIG. 3 is a cross-section through the retaining body in accordance with the line III—III of FIG. 2, FIG. 4 is a longitudinal section through the retaining body without the securing ring and the bottom plate in accordance with the line IV—IV of FIG. 3.

DESCRIPTION OF THE PREFERRED EMBODIMENT

Figure 5:
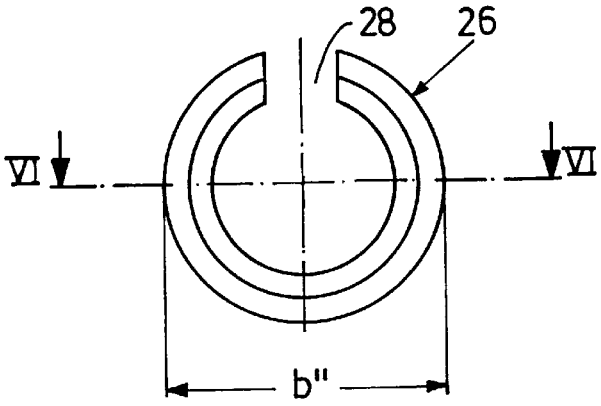
FIG. 5 is a plan view of the securing ring.
Figure 7:
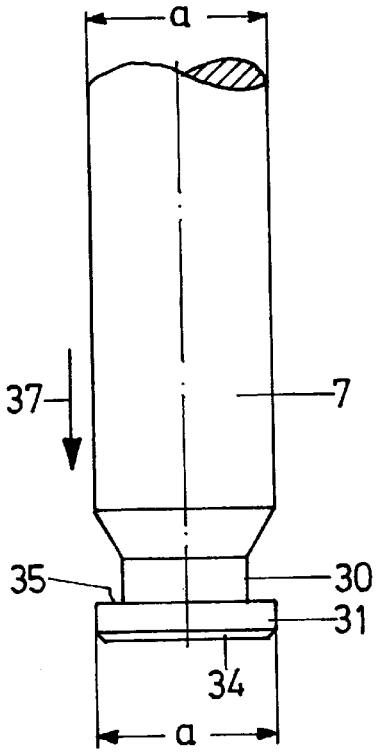
FIG. 7 is an illustration of part of a piston rod.

The chair column seen in the drawing comprises an upright tube 1 in which an adjustable-length gas spring 2 is disposed as a pneumatic or hydropneumatic piston-cylinder adjusting element. The upright tube 1 and the gas spring 2 have a common central longitudinal axis 3. An external housing 4 of the gas spring 2 is supported for displacement in the direction of the axis 3 in a guide bush 5 which is disposed on an upper end 6—in the drawing—of the upright tube 1. This external housing 4 of the gas spring 2 may be the housing of the gas spring itself or a protecting tube externally enveloping the latter.

A piston rod 7 projects from the housing 4 of the gas spring 2; which is supported relative to a bottom plate 9 of the upright tube 1 in the direction of the axis 3 by way of a supporting and bearing unit 8. The bottom plate 9 is located at the other end 10, opposite the end 6, of the upright tube 1 seen at the bottom of the drawing. The gas spring 2, by its piston rod 7, is fixed relative to the upright tube 1 in the direction of the axis 3 so that upon adjustments in length of the gas spring 2 by actuation of the actuating pin 11, the housing 4 of the gas spring 2 is extracted out of, or retracted into, the upright tube 1. The actuating pin 11 is located at the end, opposite the piston rod 7, of the housing 4 of the gas spring 2. This is where a seat or the like is mounted.

In vicinity to the end 10, the upright tube 1 comprises a cone section 12 which tapers slightly conically towards the end 10 and by means of which fixing of the upright tube 1 in a corresponding cone bush of a chair pedestal or the like is possible.

As far as described—with the exception of the supporting and bearing unit 8 and the associated part of the piston rod 7—the column, which serves primarily as a chair column, is generally known, commercial, and specified and illustrated for instance in U.S. Pat. No. 3,711,054 or in U.S. Pat. No. 4,979,718.

The annular-disk-type bottom plate 9 supports itself on an edge 13 rolled inwards in the shape of a cup in the vicinity of the end 10 of the upright tube 1. The cross-sectional shape of this inward edge 13 is approximately semi-circular, i.e. the edge has about the cross-section of a semi-circular ring.

So as to prevent the bottom plate 9 from being pulled upwards out of the upright tube 1, projections 15 are formed, which project from the inside wall 14 within the upright tube 1 directly above the bottom plate 9 and which can be produced by being forced in from outside. For instance, provision can be made for six projections 15 of this type to be regularly distributed on the circumference. The measure serves to prevent that for instance when the chair is lifted by its seat, the gas spring 2 and the bottom plate 9 are pulled upwards out of the upright tube 1. So, these projections 15 need not take up any higher forces, but only the weight of the upright tube 1 and the chair pedestal fixed to it. Such a design of supporting and fixing the bottom plate 9 is likewise commercial and generally known, and illustrated and specified for instance in U.S. Pat. No. 4,969,619. The bottom plate can also be formed in one piece with the upright tube or welded together with it.

As seen in FIGS. 2 to 4, the supporting and bearing unit 8 comprises a retaining body 16 which substantially has the shape of a cylindrical cage. This cage is formed by an annular upper bearing ring 17 and a circular-disk-type lower supporting plate 18, both being connected with each other by means of vertical bars 19, 19'. Connected with the bearing ring 17 are locking arms 20 which are parallel to the vertical bars 19, 19' and to the axis 3, and which are directed towards the supporting plate 18, and which—as seen in FIG. 4—are partially cylindrical, extending over slightly less than 180°. They end each before the diametrically opposed vertical bars 19, whereas the vertical bars 19'—relative to the axis 3—are disposed radially outside the locking arms 20. At their free ends neighboring the supporting plate 18, the locking arms 20 have locking cheeks 21 projecting in the direction towards the axis 3, i.e. inwards, a transitional surface 22 in the shape of a partial truncated cone being formed between the locking arms 20 and the locking cheek 21.

A fastening pin 23 is formed coaxially with the axis 3 on the lower side of the supporting plate 18, in the vicinity of its free end having a supporting collar 24 which tapers in the form of a truncated cone towards the free end. A retaining collar 25 is formed on the fastening pin 23 between the supporting collar 24 and the supporting plate 18.

Figure 6:
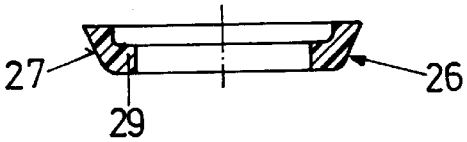
FIG. 6 is a cross-section through the securing ring in accordance with the line IV—IV of FIG. 5.

The supporting and bearing unit 8 further comprises a securing ring 26 illustrated in FIGS. 5 and 6, which—as seen in FIG. 6—comprises an outer surface 27 tapering in the shape of a truncated cone. The securing ring 26 has a slit 28. In the vicinity of where the outer surface 27 tapers most, the securing ring 26 is provided with an inward annular section 29 projecting inwards radially to the axis 3.

In the vicinity of its free end, the piston rod 7 has a necking 30 which is adapted to the locking arms 20 having the locking cheeks 21. On its free end, the piston rod 7 has a locking collar 31, the diameter a of which corresponds to the otherwise cylindrical piston rod 7.

The assembly takes place as follows:

The securing ring 26 of elastic material is slipped over the supporting collar 24 and onto the fastening pin 23. The annular section 29 takes its place between the supporting collar 24 and the retaining collar 25 as seen in FIG. 2, there being however some clearance 32 between the annular section 29 and the fastening pin 23 so that the securing ring 26 can be compressed still further radially towards the axis 3. As also seen in FIG. 2, in the released condition of the securing ring 26, the latter's outer surface 27 combines with the outer surface 33 of the supporting collar 24 to form a surface in the form of a continuously truncated cone.

Subsequently, the retaining body 16 is pushed onto the piston rod 7, the locking collar 31 deflecting the locking arms 20 in the direction towards the vertical bars 19' when the locking collar 31 is slipped through between the transitional surfaces 22 and the locking cheeks 21 of the locking arms 20. Once the locking collar 31 has been moved through the locking arms 20, it will bear by its front 34 against the supporting plate 18. Simultaneously, the locking arms 20 are released by it, snapping inwards radially to the axis 3 so that the transitional surfaces 22 of the locking cheeks 21 rest in the necking 30. Since the surfaces 35, 36, turned towards each other, on the locking collar 31 on the one hand and on the locking cheeks 21 on the other extend radially to the axis 30, the locking connection of the retaining body 16 with the piston rod 7 cannot be detached by a force counter to the direction of insertion 37. The inside diameter a' of the locking arms 20 approximately corresponds to the diameter a of the piston rod 7 and the locking collar 31 so that the retaining body 16 is mounted on the piston rod 7 radially substantially free from play. The locking collar 31 rests substantially free from play between the supporting plate 18 and the locking arms 20 also in the direction of the axis 3. The distance a" of the two diametrically opposed vertical bars 19 is approximately equal to the diameter a so that any detachment of the connection between the piston rod 7 and the retaining body 16 by deflection of the piston rod 7 relative to the retaining body 16 is precluded between the locking arms 20.

The subsequent mounting of the retaining body 16 on the bottom plate 9 takes place in such a way that the supporting collar 24 is moved from inside the upright tube 1 through an opening 38 formed in the bottom plate 9 coaxially to the axis 3. The diameter b of this opening 38 slightly exceeds the greatest diameter b' of the outer surface 33 of the supporting collar 24. The diameter b of the opening 38 is however smaller than the greatest diameter b" of the securing ring 26 in the released condition seen in the drawing. When pushed through the opening 38, the securing ring 26 is compressed, which is possible without any difficulties due to the slit 28 and the clearance 32 between the annular section 29 and the fastening pin 23. Once the securing ring 26 has been pushed through the opening 38, the securing ring 26 expands, bearing against the lower side 39 of the bottom plate 9. Since the diameter c of the fastening pin 23 in the vicinity of the opening 38 is distinctly smaller than the latter's diameter b, the piston rod 7 has some minor radial play radially to the bottom plate 9 and thus to the upright tube 1 so that the piston rod 7, together with the retaining body 16, can yield radially, should the gas spring 2 not be guided precisely coaxially in the guide bush 5 of the upright tube 1. The bottom plate 9 is disposed approximately free from play between the supporting plate 18 and the securing ring 26. The piston rod 7 is axially rotatable relative to the retaining body 16 and/or the retaining body relative to the bottom plate 9 so that the gas spring 2 as a whole is rotatable about its axis 3 in the upright tube 1.

For the connection between the gas spring 2 and the upright tube 1 to be released, the securing ring 26 is either compressed so that it can again be slipped through the opening 38 of the bottom plate 9, or it is widened to such an extent that it can be pulled over the support collar 24. Furthermore, it is possible to draw the securing ring 26 off the fastening pin 23 at right angles to the axis 3 by corresponding expansion in the vicinity of its slit 28.

When the gas spring 2 is retracted as far as possible , then the housing 4 contacts the bearing ring 17 of the retaining body 16. In this regard, the retaining body 16 replaces the conventional stop absorbers of rubber or the like. This is in particular supported by the retaining body consisting of hard elastic plastic material and by the portion above the bottom plate 9 being formed as a cage.

Figure 8:
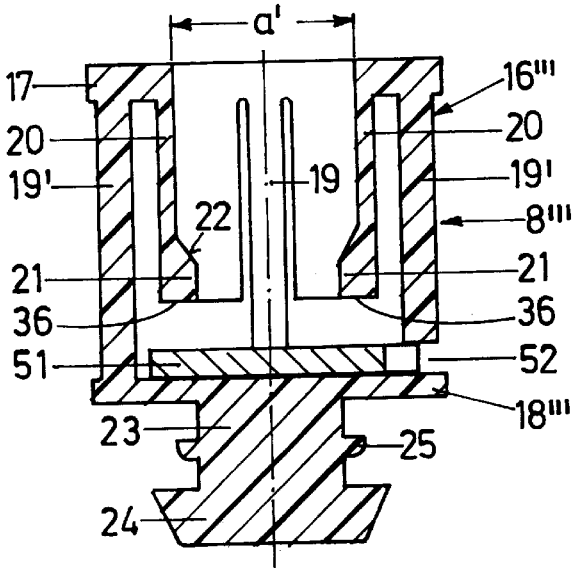
FIG. 8 is an illustration of an embodiment of the retaining body modified as compared to FIG. 4.

FIG. 8 illustrates a slightly modified embodiment of a retaining body 16''', which differs from the one of FIGS. 2 to 4 by the supporting plate 18''' being reinforced by an additional disk-type reinforcing body 51. This reinforcing body 51 may be provided in the supporting and bearing unit 8''' by injection-molding or it can be inserted through a lateral opening 52 so that it rests on the supporting plate 18'''. The piston rod 7 will then bear by its front 34 on this reinforcing body 51, which consists of metal as a rule. The retaining body 16''' combines with the securing ring 26 to form a supporting and bearing unit 8'''.

What is claimed is:

1. An adjustable-length column for chairs, comprising:

an upright tube (1) having a bottom plate (9), which bottom plate (9) has an opening (38), which opening (38) has a diameter (b); and a length-adjusting element, which is disposed in said upright tube (1) concentrically of a common central longitudinal axis (3), said length-adjusting element having a housing (4), which is radially supported in said upright tube (1) and guided in said upright tube (1) for displacement in the direction of said central longitudinal axis (3) and which is at least partially filled with gas under pressure; and a piston rod (7), which has a free end outside said housing (4), which piston rod (7), in the vicinity of said free end, is fixed on said bottom plate (9) against movements in the direction of said central longitudinal axis (3), wherein the piston rod (7) is flexibly snap-engaged with said bottom plate (9), wherein a fastening pin (23), which passes through the opening (38) of the bottom plate (9), is connected with the piston rod (7), a securing ring (26) being disposed on the fastening pin (23), backing up the bottom plate (9) and being compressible radially to said central longitudinal axis (3) to have a diameter smaller than the diameter b of the opening (38), wherein the fastening pin (23) is part of a retaining body (16) which is disposed on said free end of the piston rod (7), wherein the retaining body (16) is supported on the bottom plate (9) by means of a supporting plate (18), wherein the front (31) of the piston rod (7) bears against the supporting plate (18, 18''').

2. An adjustable-length column according to claim 1, wherein on an end of the retaining body (16) turned towards the housing (4) is provided with a bearing ring (17) as an abutment for the housing (4).

3. An adjustable-length column according to claim 1, wherein the retaining body (16) is flexibly snap-engaged with the piston rod (7).

4. An adjustable-length column according to claim 3, wherein the retaining body (16) comprises locking arms (20) which engage with a necking (30) of the piston rod (7).

5. An adjustable-length column according to claim 1, wherein the retaining body (16) integrally consists of hard elastic plastic material.

6. An adjustable-length column according to claim 1, wherein in the supporting plate (18''') of the retaining body (16''') is provided with a reinforcing member (51) wherein the front of the piston rod (7) bears against the supporting plate (18''') through the reinforcing member (51).

7. An adjustable-length column according to claim 1, wherein the retaining body (16) and the securing ring (26) form a supporting and bearing unit (8).

8. An adjustable-length column according to claim 1, wherein the retaining body (16) is formed as a cage between a bearing ring (17) and a supporting plate (18).

9. An adjustable-length column according to claim 1, wherein the securing ring (26) is disposed between a supporting collar (24) formed on a free end of the fastening pin (23) and a retaining collar (25) and engages between said supporting collar (24) and said retaining collar (25) by an annular section (29).

* * * * *